US005788584A

United States Patent [19]

Parente et al.

[11] Patent Number: 5,788,584

[45] Date of Patent: *Aug. 4, 1998

[54] GOLF CLUB HEAD WITH PERIMETER WEIGHTING

[75] Inventors: Richard E. Parente, San Diego; Danny C. Ashcraft, Vista; Richard De La Cruz, Pauma Valley, all of Calif.

[73] Assignee: Goldwin Golf U.S.A., Inc., Carlsbad, Calif.

[ * ] Notice: The term of this patent shall not extend beyond the expiration date of Pat. No. 5,527,043.

[21] Appl. No.: 270,921

[22] Filed: Jul. 5, 1994

[51] Int. Cl.[6] ..... A63B 53/04

[52] U.S. Cl. ..... 473/290; 473/345; 473/349; 473/291

[58] Field of Search ..... 273/77 R, 77 A, 273/79, 167 A, 167 J, 169, 167 F, 167 H, 174, 193 R, 194 R; 473/324, 329, 330, 332, 334, 335, 336, 337, 338, 339, 341, 345, 346, 350, 349, 287, 288, 289, 290, 291, 256

[56] References Cited

U.S. PATENT DOCUMENTS

| | | | |
|---|---|---|---|
| 1,167,106 | 1/1916 | Palmer . | |
| 1,235,922 | 8/1917 | Pittar . | |
| 1,269,745 | 6/1918 | Robertson . | |
| 1,526,438 | 2/1925 | Scott . | |
| 1,568,888 | 1/1926 | Dunn . | |
| 1,582,836 | 4/1926 | Link . | |
| 1,601,770 | 10/1926 | Reach et al. . | |
| 1,616,920 | 2/1927 | Pedersen . | |
| 1,968,092 | 7/1934 | Oldham . | |
| 2,067,556 | 1/1937 | Wettlaufer . | |
| 2,171,383 | 8/1939 | Wettlaufer . | |
| 2,447,967 | 8/1948 | Stone . | |
| 3,191,936 | 6/1965 | Guier . | |
| 3,212,783 | 10/1965 | Bradley . | |
| 3,819,181 | 6/1974 | Mills . | |
| 3,941,390 | 3/1976 | Hussey . | |
| 3,967,826 | 7/1976 | Judice . | |
| 3,976,299 | 8/1976 | Lawrence et al. . | |
| 3,995,865 | 12/1976 | Cochran et al. . | |
| 4,021,047 | 5/1977 | Mader . | |
| 4,063,737 | 12/1977 | Tom et al. . | |
| 4,214,754 | 7/1980 | Zebelean . | |
| 4,429,879 | 2/1984 | Schmidt . | |
| 4,438,931 | 3/1984 | Motomiya . | |
| 5,028,049 | 7/1991 | McKeighen | 273/167 H |
| 5,090,702 | 2/1992 | Viste . | |
| 5,232,224 | 8/1993 | Zeider . | |
| 5,290,035 | 3/1994 | Hannon | 273/167 H |
| 5,527,034 | 6/1996 | Ashcraft | 473/345 |

FOREIGN PATENT DOCUMENTS

| | | |
|---|---|---|
| 211781 | 12/1957 | Australia . |
| 371974 | 5/1932 | United Kingdom . |
| 398643 | 9/1933 | United Kingdom . |
| 679292 | 9/1952 | United Kingdom . |
| 1476889 | 6/1977 | United Kingdom . |

OTHER PUBLICATIONS

"Golf Digest", Magazine, May 1977 Issue, p. 78. (copy in class 273, subclass 77A).

"Weekly Golf Digest", Magazine, May 15, 1992 Issue, pp. 60–65.

*Primary Examiner*—Sebastiano Passaniti

*Attorney, Agent, or Firm*—Cooley Godward

[57] ABSTRACT

A golf club metal wood head made of lighter weight material than stainless steel, such as aluminum alloy, has a front wall with an outer striking face, an upper wall, a lower wall, a rear wall, a heel and a toe, and an internal cavity milled out through a wall of the head to selected dimensions to provide a selected front wall thickness, and a varying wall thickness around the remainder of the head to provide a selected perimeter weighting to the head. The front wall is made significantly thicker than in conventional heads.

20 Claims, 2 Drawing Sheets

GOLF CLUB HEAD WITH PERIMETER WEIGHTING

CROSS-REFERENCES TO RELATED APPLICATIONS

This application is related to our co-pending U.S. application Ser. No. 08/159,738 filed Nov. 30, 1993.

BACKGROUND OF THE INVENTION

The present invention relates generally to golf clubs and is particularly concerned with golf clubs of the metal wood type.

Most metal woods are conventionally made by investment casting a hollow stainless steel shell. There are stringent weight requirements for metal wood club heads, depending on the weight of the attached shaft. Typically, the club head weight must be an average of 198 grams for a steel head to 208 grams for a graphite head. In order to meet these weight requirements, the walls of such stainless steel club heads must be kept relatively thin. This causes problems due to the inherent inaccuracies in investment casting, resulting in a relatively high percentage of rejections and also potential head failure if very thin spots are produced in the final head. Also, the weight requirements are such that the all or most of the weight of material is required to be distributed about the head in such a way as to maintain structural integrity, and cannot be used for enhanced perimeter weighting and thus improved playability of the head. In a typical stainless steel investment cast head, the front face thickness is no greater than about 0.12 inches while the perimeter walls are no more than about 0.03 inches thick. Another problem is that it is not normally possible to make extra large club heads in this way because of the resultant excessive weight, and even if an extra large head is made, the walls must be extremely thin to meet weight requirements, so that there is absolutely no weight left over to distribute about the head for improved playability.

Honeycomb reinforcing is sometimes used in investment cast metal woods in order to reinforce the relatively thin striking face and allow it to be made lighter, and also provide enhanced perimeter weighting. In U.S. Pat. No. 5,060,951 of Allen, a thin-walled cast head is made with an enlarged ball striking face and a reinforcing structure to permit the club face size to be increased without significant increase in weight.

SUMMARY OF THE INVENTION

It is an object of the present invention to provide a new and improved golf club head with perimeter weighting.

According to one aspect of the present invention, a golf club head is provided which comprises a body having a front wall, a rear wall, an upper wall, a lower wall, a heel and a toe, the front wall having an outer striking face, the body being made of forged aluminum alloy, and having an empty internal cavity milled out through a wall of the body to provide a selected wall thickness variation and corresponding weight distribution or perimeter weighting about the club head. The overall wall thickness is significantly greater than for a stainless steel investment cast head, providing a much stronger head which is more resistant to damage, and allowing for a greater variation in weight distribution about the head and thus greater flexibility in designing the head to produce different playing effects.

The club head is preferably made of aluminum or aluminum alloy material, or other material of equivalent weight and strength. In a preferred embodiment of the invention, the club head is of 7075 T6 aluminum alloy.

Preferably, the thickness of the front wall is at least 0.2 inches, and the thickness is constant over the striking face. The wall thickness is preferably greater at the heel and toe than over the remainder of the peripheral walls around the body, in order to produce a larger sweet spot. The peripheral weighting is preferably arranged so that the sweet spot is centered very close to the center of gravity of the striking face, slightly above the geometrical center of the face. The toe and heel weighting also provides improved playability, consistency and accuracy, and will tend to propel the ball farther than a conventional investment cast stainless steel head.

The club head may be made in a range of different sizes, including a shallow, standard and large or deep head, the large or deep head having a larger striking face than normal. The striking face of the three heads has a maximum face height in the range of 1.5 inches for the shallow head up to 1.75 inches for the large head. Preferably, the club head has a separate sole plate which is secured in a suitably machined recess in the lower wall of the body. In a preferred embodiment of the invention, the dimensions of the recess for receiving the sole plate, and the sole plate itself, are progressively larger from the shallow to the deep head to provide for the three different size heads. The separate sole plate may be of the same material as the remainder of the head, or it may be of a different aluminum alloy such as 6061 T6 aluminum alloy, for example.

Preferably, the cavity has inner walls which are machined or cut across at least the upper wall of the body to provide a series of grooves and ridges of selected contour, both to provide the desired wall thickness and also to provide additional strength and to produce some vibration damping.

The cutting pattern inside the cavity allows weight to be distributed very accurately about the club head according to the desired playing characteristics and properties of the resultant club. The thickness can be varied easily both from heel to toe and front to rear of the club head, allowing for a large range of different playing characteristics.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
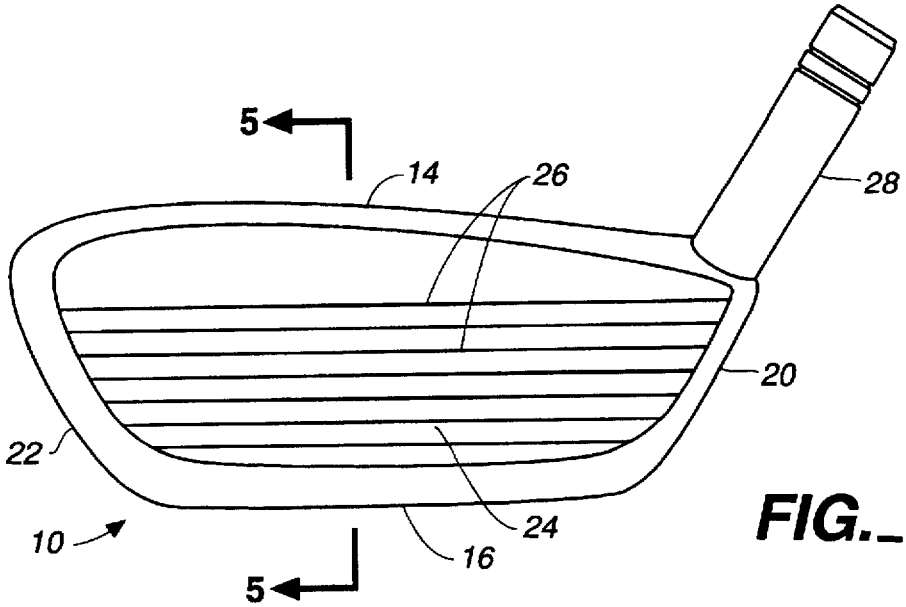
FIG. 1 is a front elevation view of a golf club head according to a preferred embodiment of the invention.
Figure 2:
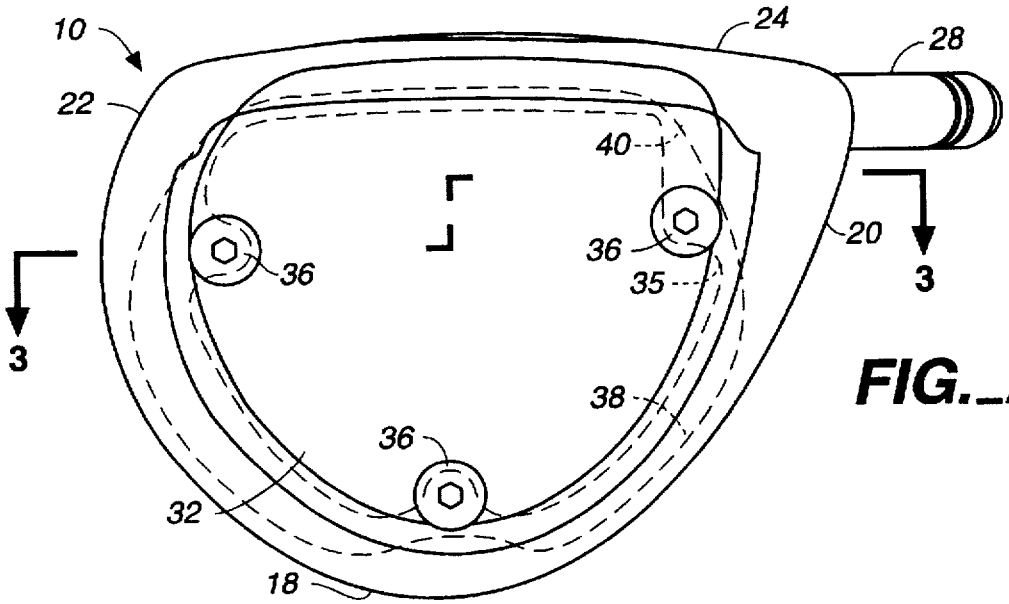
FIG. 2 is a bottom plan view of the club head.
Figure 3:
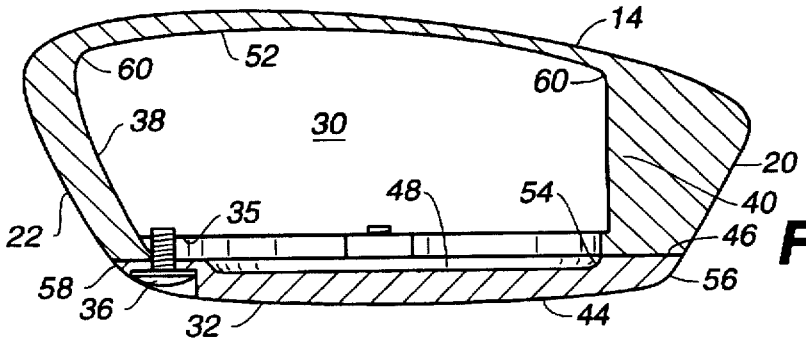
FIG. 3 is a sectional view taken on line 3—3 of FIG. 2.
Figure 4:
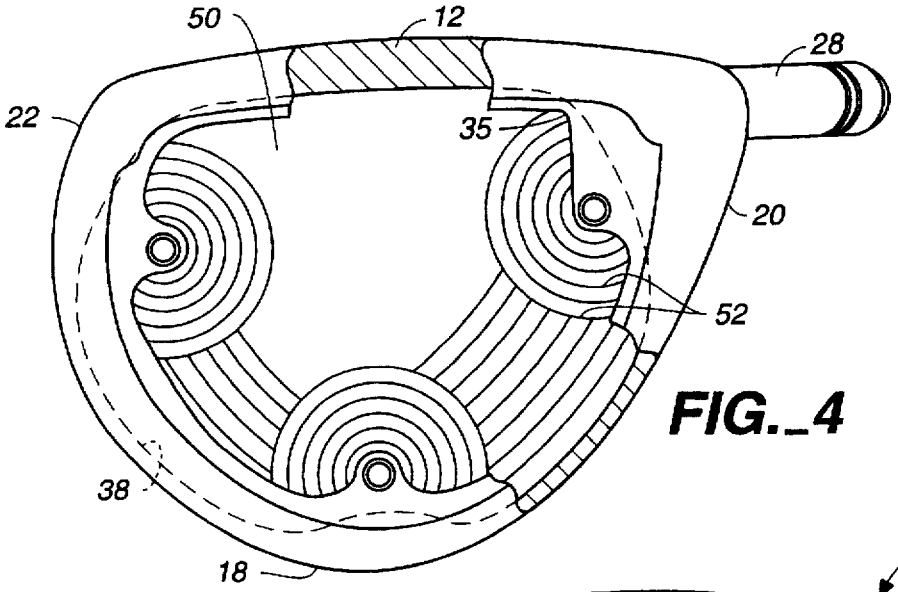
FIG. 4 is a bottom plan view of the club head, with the sole plate removed to show the machining technique for providing the required wall thicknesses and weight distribution.
Figure 5:
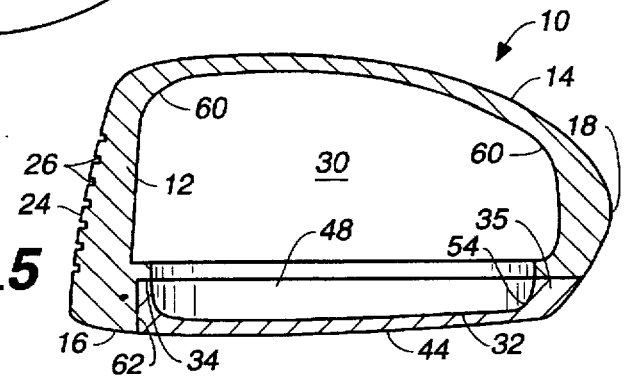
FIG. 5 is a sectional view taken on line 5—5 of FIG. 1.

FIGS. 1–5 of the drawings illustrate a golf club head 10 according to a preferred embodiment of the present invention. Head 10 has a front wall 12, upper wall or crown 14, lower wall 16, rear wall 18, heel 20 and toe 22. Front wall 12 has an outer, ball striking face 24 with a plurality of parallel score lines 26 extending in a heel to toe direction. A hosel or tube neck 28 extends into a bore at the heel end of crown 14 for receiving the end of a suitable golf club shaft (not illustrated), preferably as described in our co-pending application entitled "Golf Club Head" which was filed on even date herewith, the contents of which are incorporated herein by reference. The head has a machined or milled internal cavity 30 which is formed by machining through the lower wall 16. A separate sole plate 32 is secured in a suitably machined recess 34 in the lower wall having an opening 35 leading into the cavity 30. The sole plate 32 is secured in position by suitable fastener screws 36 or other securing means such as bonding, welding or other fastener devices. Screws 36 may be provided in different lengths to allow weighting adjustment, as described in our co-pending application entitled "Golf Club Head with Adjustable Weighting" filed on even date herewith, the contents of which are incorporated herein by reference. As best illustrated in FIGS. 1, 3 and 5, the opening 35 leading into the cavity is of smaller dimensions than the inner wall 38 of the cavity itself, forming a ledge or seat on which the sole plate 32 can be located.

The cavity 30 is formed to precise dimensions in order to produce a desired or selected front wall thickness and perimeter weighting, and to maintain club head weight within the specified range. The cavity is cut so as to vary the wall thickness from the front to the rear of the club. Preferably, the club head is formed of a relatively light weight but strong metal, which is significantly lighter than stainless steel. In a preferred embodiment of the invention the club head is formed from forged, high strength aluminum alloy, for example 7075 T6 or 6061 T6 aluminum alloy, as described in our co-pending application Ser. No. 08/159,738, filed Nov. 30, 1993, the contents of which are incorporated herein by reference.

The wall thickness is preferably greater at the front wall than at the rear wall of the club head, as best illustrated in FIG. 4. The wall thickness is also increased at the heel and toe adjacent the front wall in order to add heel and toe weight and thus increase the size of the so-called "sweet spot." The wall thickness is also thicker in the skirt or side walls extending rearwardly around each side towards the rear wall. The thickened portions provide additional weight at the heel and toe, increasing the sweet spot and improving playability and accuracy. By providing some thickening in the skirt walls, the desired perimeter weighting is obtained while at the same time the center of gravity is moved towards the rear for enhanced gear effect.

The sole plate is machined to be an interference fit in recess 34, as described in our co-pending application entitled "Golf Club Head with Interlocking Sole Plate," filed on even date herewith, the contents of which are incorporated herein by reference. The sole plate is of the same or a similar material to the remainder of the club head, and is preferably of forged aluminum alloy such as 7075 T6 or 6061 T6 aluminum alloy. In a preferred embodiment of the invention, the sole plate is of 6061 T6 aluminum alloy while the remainder or body of the head is of 7075 T6 aluminum alloy, which is stronger than 6061 T6 aluminum alloy. These two alloys, when anodized, will be of slightly different colors, providing a distinctive appearance to the club head.

The outer surfaces of the club head and sole plate are machined together with the sole plate secured in the recess, so that a smooth transition between the sole plate and the remainder of the head is produced. The upper wall or crown 14 has a smooth, slightly curved outer surface which curves slightly upwardly from the rear to the front of the club and also from the heel to the toe. The front, striking face is machined to have any selected bulge and roll, for example as illustrated in FIGS. 4 and 5. The peripheral side walls of the club at the rear, heel and toe are inclined smoothly inwardly from the crown to the lower surface or sole 44 of the sole plate 32, which is of reduced area so as to produce a smaller footprint for the club and thus less resistance when hitting a ball on the ground without a tee.

The internal surfaces of the club head are precisely machined to provide the desired wall thicknesses. Because of the relatively light-weight material used to manufacture the club head, the entire weight of material is not needed for structural integrity, unlike a cast stainless steel head. In the forged aluminum alloy head, 45 grams of material will not be needed for structural integrity and can therefore be distributed as desired by varying the wall thickness in selected areas. Preferably, the machining is performed by a computer controlled milling machine, or CNC machine, which is suitably programmed to produce the desired wall thicknesses, as described in co-pending application Ser. No. 08/159,738 referred to above. The inner face 46 of the sole plate is preferably also machined to produce a recessed area 48 which forms a continuation of the cavity 30 when the sole plate is secured in place, and also controls the actual sole plate thickness or wall thickness at the sole of the club. Recessed area 48 is surrounded by a peripheral, flat rim which mates with the flat rim of the recess 34 in the body of the club head surrounding opening 35 when the sole plate is secured in the recess, as illustrated in FIGS. 3 and 5.

Preferably, grooved cuts 50 separated by ridges 52 are formed on the inner surface of the cavity 30 across at least the crown of the club body and across the recessed area of the inner face of the sole plate to form a generally corrugated inner surface. The cuts may be formed in patterns as illustrated in FIG. 4, for example, with arched cuts expanding from the heel, toe and center of the rear wall, and linear cuts extending between adjacent sets of arched cuts. The grooved cuts allow for precise control of the wall thickness, and also add rigidity to the wall and possibly also provide some degree of vibration damping. Grooved cuts may also be provided around the inner surface of the peripheral walls of the club head apart from the inner surface of the front wall, which is preferably arched slightly to follow the curvature of the front face, as illustrated in FIG. 4.

The recessed area 48 of the sole plate is preferably also cut so as to provide some degree of peripheral weighting. Thus, the periphery 54 of recessed area 48 is cut so as to provide increased thickness of material in the sole plate at the heel 56 and toe 58, so as to help control the position of the center of gravity and the size of the sweet spot.

The internal corners of the club head are curved to form a smooth radius 60 at the transition from the peripheral side and rear walls to the crown and lower wall, and from the front wall to the crown, as illustrated in FIGS. 3 and 5. The internal radius at each corner strengthens the head at these locations and provides resistance to breakage or damage.

The wall thickness can be precisely varied both from heel to toe, front to rear and crown to sole of the club head by computer controlled milling of the internal surfaces of the cavity 30. The milling machine can be suitably programmed to produce the desired wall thicknesses using suitable cutting tools for cutting across the various internal surfaces, as will be understood by those skilled in the field of CNC machines. Appropriate wall thicknesses can be selected at various locations in order to provide the desired perimeter weighting and overall club head thickness. It will be understood that different clubs may be made having different wall thicknesses and thus different playing characteristics. In one specific example which has been found to have very good playing characteristics and accuracy when used by a professional golfer, the front wall of the club head had a substantially uniform thickness of 0.20 inches, the crown or upper wall had a substantially uniform thickness of approximately 0.070 inches, and the rear or back wall had a thickness of around 0.070 inches, as did the side walls apart from the heel and toe regions. The front wall thickness may alternatively be varied from a thinner region at the center to thicker regions of thickness increasing outwardly from the center. The sole plate thickness over the sole of the club was of an average minimum thickness of 0.070 inches. Preferably, the thickened area 40 at the heel has a maximum thickness of up to 1 inch, while the thickened area 42 at the toe has a maximum thickness of up to ½ inch. The peripheral side and rear walls are of tapering thickness extending from the heel and toe around the rear of the club head, so that all of the increased weight is not in the heel and toe at the front face. This still produces the desired perimeter weighting, and also increases the gear effect. Similar thicker regions are provided in the heel and toe of the sole plate around rim 49 for an enhanced weighting effect.

The thickness at the heel and toe may be varied in order to produce the desired sweet spot and also to adjust the position of the center of gravity. Preferably, the weight of material at the heel and toe is substantially equal. By balancing the club face in a heel-to-toe and top-to-sole direction, and subsequently adjusting the cutting machine if the balance point is off-center in either direction, it is possible to position the center of gravity at the geometric center of the club face. This may produce better accuracy in playing the ball. In some cases, it may be desirable to position the center of gravity closer to the heel or toe, however, or above or below the geometrical center of the face. This can be easily achieved simply by varying the cavity dimensions.

In the preferred embodiment of the invention, weight distribution around the club head is such that the center of gravity of the face is positioned 0.15 inches above the geometric center or measured dead center of the face. This is achieved by making at least some of the walls thicker at their upper ends, or increasing thickness at the crown. By moving the center of gravity upwards, playability is improved and the ball spin will be reduced, tending to produce a more parabolic flight path.

The rear wall 18 may also be of increased thickness, if desired. This will tend to move the center of gravity back from the front face, producing an enhanced gear effect.

Figure 6:
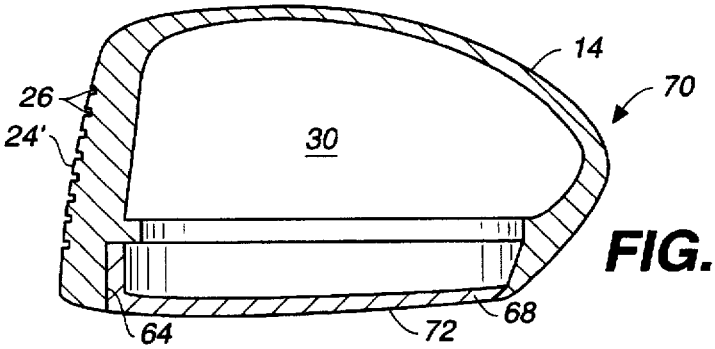
FIG. 6 is a similar sectional view with a thicker sole plate and different wall thicknesses.
Figure 7:
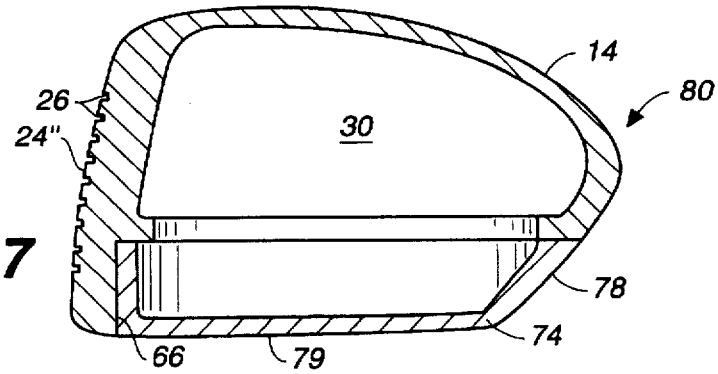
FIG. 7 is a similar sectional view with a further thickened sole plate and weight distribution.

The club head is preferably made in at least three different sizes, including a shallow size head 10 as illustrated in FIGS. 1–5, a larger, standard size head 70 as illustrated in FIG. 6, and a larger, deep head 80 as illustrated in FIG. 7. Apart from the difference in dimensions, the standard and deep heads are identical to the shallow head 10, and like reference numerals have been used for like parts as appropriate. These heads have progressively larger striking faces 24, 24' and 24" of increasing height or depth. The depth or height of striking face 24 of the shallow head 10 is preferably of the order of 1.5 inches, while the heights of striking faces 24' and 24" of the standard and deep heads 70 and 80 are 1.625 inches and 1.75 inches, respectively. Striking face 24 has a series of 7 score lines 26, while striking face 24' has a series of 8 equally spaced score lines and the deep striking face 24" has 9 score lines. The striking faces of the three different size heads differ only in depth, and are of approximately equal width.

In order to accommodate the additional depth of the standard and deep heads, the front wall 12 only is extended downwardly below the rim of recess 34 by a predetermined amount, to provide a progressively deeper lip 62,64,66 from the shallow to the deep club. The depth or thickness of the sole plate is correspondingly increased to match that of the respective lip, while the recess 48 becomes deeper so that the lower wall of the sole plate is very thin, as illustrated in FIGS. 5–7. Thus, as illustrated in FIG. 6, the sole plate 68 of the standard club head 70 is deeper than sole plate 32 of the shallow head, and has rear and side walls which taper downwardly to a substantially flat sole or lower face 72 which is of similar dimensions to sole 44 of the shallow club head. Similarly, as illustrated in FIG. 7, sole plate 74 of the deep club head 80 is deeper than standard sole plate 68 so as to provide an exact fit in the recess formed by extended lip 66. The rear wall and side walls of the sole plate have a steeper taper 78 down to a substantially flat sole or lower face 79 which is of similar dimensions to the soles 44 and 72 of the other two club heads. Thus, the very large or deep head 80 has a footprint which is similar to that of the two smaller heads and has no greater resistance to striking the ball on the ground without a tee.

The overall weight of the three different size heads is about the same, so the walls are progressively made thinner from the shallow to the deep head. Thus, the front wall is thinner on the deep head, and the projecting lip 66 is also reduced in thickness relative to the other two heads. The sole plate is made correspondingly larger to fit in the enlarged recessed area.

The sole plates 68 and 74 are secured in the respective recesses in the standard and deep club head bodies by fastener screws 36 in an identical manner to the shallow club head 10. The fastener screws 36 in the shallow head are positioned more or less entirely on the flat sole 44 of the shallow sole plate 32. However, in view of the steeper and deeper taper on the standard and deep sole plates, the fastener screws on these heads overlap onto the tapered sides of the sole plate, and are mounted in recessed holes in the sole plate which overlap the tapered sides in equivalent positions to the recessed holes in the shallow sole plate, as illustrated in FIG. 3.

Preferably, the sole plates 32, 68 and 74 are made of a different aluminum alloy to the remainder of the club head, which will anodize to a slightly different color or finish so that the sole plate stands out from the remainder of the club head. For example, the body of the club head may be of 7075 T6 aluminum alloy while the sole plates are all of 6061 T6 aluminum alloy, which anodizes to a slightly different color. This makes it easy to distinguish between the shallow, standard and deep heads since the sole plates stand out from the remainder of the club head and the difference in thickness or depth of the sole plate is immediately apparent. The sole plates may be made of different color metal, or have a different finish, in alternative embodiments.

The front wall of the club head is relatively thick even in the largest, deep head which can be made larger than the maximum size investment cast stainless steel head, thus producing an enlarged sweet spot. In a stainless steel, super large head, the maximum height of the front face is typically 1.625 to 1.72 inches, and the walls must be made thinner to allow for this height while keeping within maximum weight limits. This results in relatively large amounts of club face deflection, producing inconsistent or inaccurate performance. Also, because of the extra weight in the front wall of the club head, there is little or no weight left over for any perimeter weighting, which also results in an inferior club performance. By making the club head of relatively lightweight, forged aluminum alloy, these problems are significantly reduced or avoided. The front wall of the club can be of up to 0.2 inches or more in thickness, so that it will be strong and resist face deflection. At the same time, weight can still be added at the heel and toe by making the walls thicker in these regions, as illustrated for the shallow club in FIGS. 2 and 4, without producing an unacceptably heavy club head. Thus, perimeter weighting can be adjusted as desired for improved accuracy and playability. The thicker, larger club face will increase ball distance when struck, since the energy loss usually associated with deflection and recovery is minimized. By milling out the internal cavity using a computer controlled milling machine, the club head can be customized to move weight up or down or to the heel and toe. The wall thickness can be varied in all directions, front to rear, heel to toe, and sole to crown, to provide optimum or desired playing effects. In order to vary wall thickness, the path of the cavity cutting tool is simply changed according to program instructions so as to cut out more material or leave more material along a respective cut.

The forged and machined or milled aluminum alloy club head has improved performance and reliability over conventional cast stainless steel club heads. Because of the lighter weight material used, the entire weight of material is not needed in order to ensure structural integrity, as is the case with most stainless steel heads, and the extra weight not needed for structural integrity can be distributed to provide heel and toe weighting as desired, and to provide a much thicker front wall for increased strength and rigidity, and considerably improved performance. The face stiffness of the metal wood in this club head exceeds that of all other metal woods, and is significantly greater than the face stiffness of previously known super large metal woods having a striking face height greater than 1.62 inches.

Although some preferred embodiments of the invention have been described above by way of example only, it will be understood by those skilled in the field that modifications may be made to the disclosed embodiments without departing from the scope of the invention, which is defined by the appended claims.

We claim:

1. A golf club head, comprising:

a body having a front wall with an outer, striking face, a rear wall, an upper wall, a lower wall, a heel and a toe, the body being made of forged aluminum alloy material; and the body having an internal cavity milled out to provide a selected front wall thickness and a selected wall thickness variation about the remainder of the body to provide a selected weight distribution about the club head.

2. The head as claimed in claim 1, wherein the front wall thickness is at least 0.20 inch.

3. The head as claimed in claim 1, wherein the striking face has a height of at least 1.5 inches.

4. The head as claimed in claim 3, wherein the striking face has a height of at least 1.625 inches.

5. The head as claimed in claim 4, wherein the striking face has a height of at least 1.75 inches.

6. The head as claimed in claim 1, wherein the body material is selected from the group consisting of 7075 T6 aluminum alloy and 6061 aluminum alloy.

7. The head as claimed in claim 1, wherein the wall thickness is greater at the front wall and the heel and toe of the body adjacent the front wall than around the remainder of the body.

8. The head as claimed in claim 1, wherein the cavity is milled out through the lower wall of the body, the lower wall having a recess and a separate sole plate secured in said recess.

9. The head as claimed in claim 1, wherein the wall thickness is greater at the heel and toe in order to provide a larger sweet spot.

10. The head as claimed in claim 1, wherein the cavity has milled internal surfaces, at least some of the milled internal surfaces having grooves and ridges.

11. The head as claimed in claim 10 wherein an internal surface of the front wall is smooth.

12. The head as claimed in claim 1, wherein the cavity has milled internal upper wall, front wall, rear wall and side wall surfaces, and radiused corners at the transition from the rear and side walls to the upper wall and lower wall, respectively.

13. A set of golf club heads of progressively increasing face sizes, comprising:

a plurality of different size golf club bodies, each body having a front wall with an outer, striking face, an upper wall, a lower wall, a rear wall, a heel and a toe, and the front striking faces of the golf club bodies being of progressively increasing height; and each golf club body having an internal cavity milled out and of selected dimensions to provide a selected front wall thickness and wall thickness variation around the remainder of the body to provide a selected perimeter weighting.

14. The set as claimed in claim 13, wherein the different size bodies comprise a body having a striking face of a first height, a body having a striking face of a second height greater than said first height, and a body having a striking face of a third height greater than said second height.

15. The set as claimed in claim 14, wherein the first height is 1.5 inches, the second height is 1.625 inches, and the third height is 1.75 inches.

16. The set as claimed in claim 13, wherein the front wall of each body has a thickness of 0.20 inch, and the golf club bodies are made of forged aluminum alloy material.

17. The set as claimed in claim 13, wherein the cavity is milled through the lower wall of each body, each body having a separate sole plate secured to said lower wall, the sole plates of the different size bodies being of increasing thickness to accommodate the increasing height of the front wall.

18. The set as claimed in claim 17, wherein each body has a surface of different appearance from the surface of the sole plate secured in the recess in that body.

19. The set as claimed in claim 18, wherein the body is of different material from the sole plate.

20. The set as claimed in claim 19, wherein the body is of 7075 T6 aluminum alloy and the sole plate is of 6061 T6 aluminum alloy.

* * * * *